US009717392B2

(12) United States Patent
Lee et al.

(10) Patent No.: US 9,717,392 B2
(45) Date of Patent: Aug. 1, 2017

(54) DISHWASHER

(71) Applicant: LG ELECTRONICS INC., Seoul (KR)

(72) Inventors: Sanghoon Lee, Seoul (KR); Sangheon Yoon, Seoul (KR); Gapsu Shin, Seoul (KR)

(73) Assignee: LG Electronics Inc., Seoul (KR)

( * ) Notice: Subject to any disclaimer, the term of this patent is extended or adjusted under 35 U.S.C. 154(b) by 234 days.

(21) Appl. No.: 14/607,246

(22) Filed: Jan. 28, 2015

(65) Prior Publication Data

US 2015/0208895 A1 Jul. 30, 2015

(30) Foreign Application Priority Data

Jan. 28, 2014 (KR) ..... 10-2014-0010756

(51) Int. Cl.
*A47L 15/42* (2006.01)

(52) U.S. Cl.
CPC ..... *A47L 15/4206* (2013.01); *A47L 15/4202* (2013.01); *A47L 15/4208* (2013.01)

(58) Field of Classification Search
CPC ..... A47L 15/4202; A47L 15/4206; A47L 15/4208
USPC ..... 134/56 D, 57 D, 58 D, 104.4, 111
See application file for complete search history.

(56) References Cited

U.S. PATENT DOCUMENTS

2011/0197933 A1* 8/2011 Yoon ..... A47L 15/4208 134/110

FOREIGN PATENT DOCUMENTS

| | | |
|---|---|---|
| CN | 1628597 | 6/2005 |
| CN | 101849809 | 10/2010 |
| DE | 9312801 U | 10/1993 |
| DE | 4418523 A1 | 11/1995 |
| EP | 2292136 A1 | 3/2011 |

OTHER PUBLICATIONS

Kohles et al., "DE 4418523 A1 English Machine Translation.pdf", Nov. 30, 1995—Machine translation from Espacenet.com.*
Office Action issued in Russian Application No. 2015102104/(003244) on Dec. 28, 2015, 5 pages (with English translation).
European Search Report dated Jun. 26, 2015 for corresponding European Patent Application No. 15152841.1, 6 pages.
Chinese Office Action in Chinese Application No. 201510042557.6, dated Feb. 24, 2017, 10 pages.

* cited by examiner

*Primary Examiner* — Michael Barr
*Assistant Examiner* — Levon J Shahinian
(74) *Attorney, Agent, or Firm* — Fish & Richardson P.C.

(57) ABSTRACT

A dishwasher includes a washing tub defining a space that is configured to receive dishes to be washed by wash water, a sump configured to receive and collect wash water flowing from the washing tub, a filter unit disposed at the sump and configured to filter the wash water flowing from the washing tub to the sump, and a cap configured to prevent the wash water received in the sump from flowing from the filter unit to the washing tub.

16 Claims, 6 Drawing Sheets

DISHWASHER

CROSS-REFERENCE TO RELATED APPLICATION

This application claims priority under 35 U.S.C. §119 to Korean Application No. 10-2014-0010756, filed Jan. 28, 2014, the subject matter of which is hereby incorporated by reference.

TECHNICAL FIELD

The present application relates to a dishwasher.

BACKGROUND

In general, a dishwasher is a device that removes contaminants, such as food wastes, from tableware or cooking utensils (hereinafter, simply referred to as "dishes") using detergent and wash water.

The dishwasher can include a main body having a washing tub, a door for opening and closing an opening part of the main body, a sump disposed at the bottom of the washing tub for storing wash water, a washing pump for pumping out the wash water stored in the sump, and spray arms for spraying the wash water pumped out by the washing pump to the washing tub. In addition, a filter for filtering foreign matter from the wash water may be mounted at the sump.

In the conventional dishwasher, however, wash water remaining in a flow channel connected between the sump and the spray arms can flow backward to the sump when the operation of the washing pump is finished with the result that the foreign matter filtered by the filter may be introduced into the washing tub.

SUMMARY

It is an object of the present application to provide a dishwasher that is capable of preventing a backward flow phenomenon of wash water flowing from a filter unit to a washing tub.

It is another object of the present application to provide a dishwasher that is capable of preventing contaminants from being separated from a filter during backward flow of wash water.

It should be noted that objects of the present application are not limited to the objects as mentioned above, and other unmentioned objects of the present application will be clearly understood by those skilled in the art to which the present application pertains from the following description.

According to one aspect, a dishwasher includes a washing tub defining a space that is configured to receive dishes to be washed by wash water, a sump configured to receive and collect wash water flowing from the washing tub, a filter unit disposed at the sump and configured to filter the wash water flowing from the washing tub to the sump, and a cap configured to prevent the wash water received in the sump from flowing from the filter unit to the washing tub.

Implementations according to this aspect may include one or more of the following features. For example, the cap may be disposed in the filter unit and configured to move upward and downward by a stream of water. The filter unit may include an outer mesh part having a mesh shape and defining an internal space, and an inner mesh part disposed in the internal space and configured to restrict an upward movement of the cap. The cap may move upward or downward, respectively, to close or open a flow channel that is configured to guide wash water flow between the filter unit and the washing tub. The dishwasher according to this aspect may further include a hook disposed in the sump and configured to restrict a downward movement of the cap. The hook may include a plurality of hooks, the plurality of hooks being spaced apart from each other to form discharge ports. The dishwasher may include a hood disposed in the sump and be configured to restrict an upward movement of the cap. The hood may be configured to contact the cap to prevent wash water from flowing from the filter unit to the washing tub. The filter unit may further include a guide pin extending through an opening hole defined in the cap in a moving direction of the cap. The cap may include a roof that faces a flow direction of wash water, and a tubular receiving unit extending downward from the roof. The cap may further include a rim protruding from the roof in a radial direction, the rim protruding more radially outward than the tubular receiving unit, and the filter unit may further include a hook for supporting the rim at a lowered position of the cap. The dishwasher may further include a spray arm configured to spray wash water into the washing tub, and a washing pump configured to pump wash water from the sump to the spray arm.

According to another aspect, a dishwasher includes a washing tub defining a space that is configured to receive dishes to be washed by wash water, a sump configured to receive and collect wash water introduced from the washing tub, a spray arm connected to the sump via a flow channel; a washing pump configured to pump the received wash water from the sump to the spray arm, a filter unit disposed in the sump and configured to filter the wash water introduced from the washing tub, and a cap disposed in the filter unit and configured to move upward and downward, the cap being configured to move downward by a stream of water introduced from the washing tub to the sump to open a flow channel connecting the filter unit and the washing tub during operation of the washing pump and being configured to move upward by wash water flowing from the spray arm to the sump to close the flow channel based on the operation of the washing pump being stopped.

Implementations according to this aspect may include one or more of the following features. For example, the filter unit may include an outer mesh part having an open top that enables communication between the washing tub and a mesh net that is formed at a side of the mesh part such that wash water introduced through the open top is filtered through the mesh net while flowing outward in a radial direction, and the cap may be disposed inside the outer mesh part. The outer mesh part may include a hook disposed at a lower side of the cap, and the hook may be configured to restrict a downward movement of the cap. The hook may include a plurality of hooks disposed at intervals in a circumferential direction. The outer mesh part may include a hood disposed at an upper side of the cap, and the hood may be configured to restrict an upward movement of the cap. The hood may define a flow channel that connects an upper region and a lower region of the hood, and the cap may be configured to, based on the cap being at a raised position, close the flow channel. The flow channel may be closed by sealing between the cap and the hood. The filter unit may include a guide pin extending upward and downward, and the cap may have an opening hole, through which the guide pin extends.

BRIEF DESCRIPTION OF THE DRAWINGS

Implementations will be described in detail with reference to the following drawings in which like reference numerals refer to like elements, and wherein.

DETAILED DESCRIPTION

Advantages, features and methods for achieving those implementations may become apparent upon referring to implementations described later in detail together with attached drawings. However, implementations are not limited to the implementations disclosed hereinafter, but may be embodied in different modes. The description is provided for disclosure to inform persons skilled in this field of art to make and use the described implementations. The same reference numbers may refer to the same elements throughout the specification.

Figure 1:
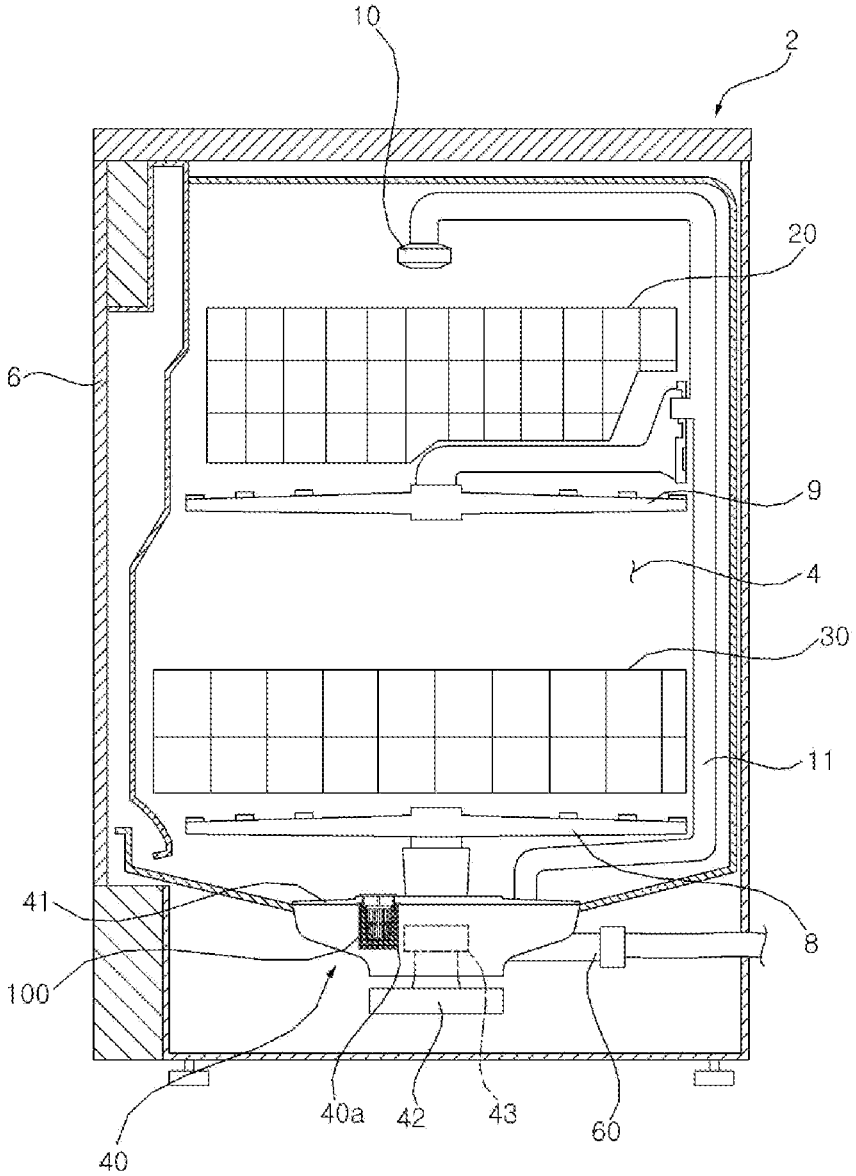
FIG. 1 is a sectional view showing an example dishwasher according to an implementation of the present application.
Figure 2:
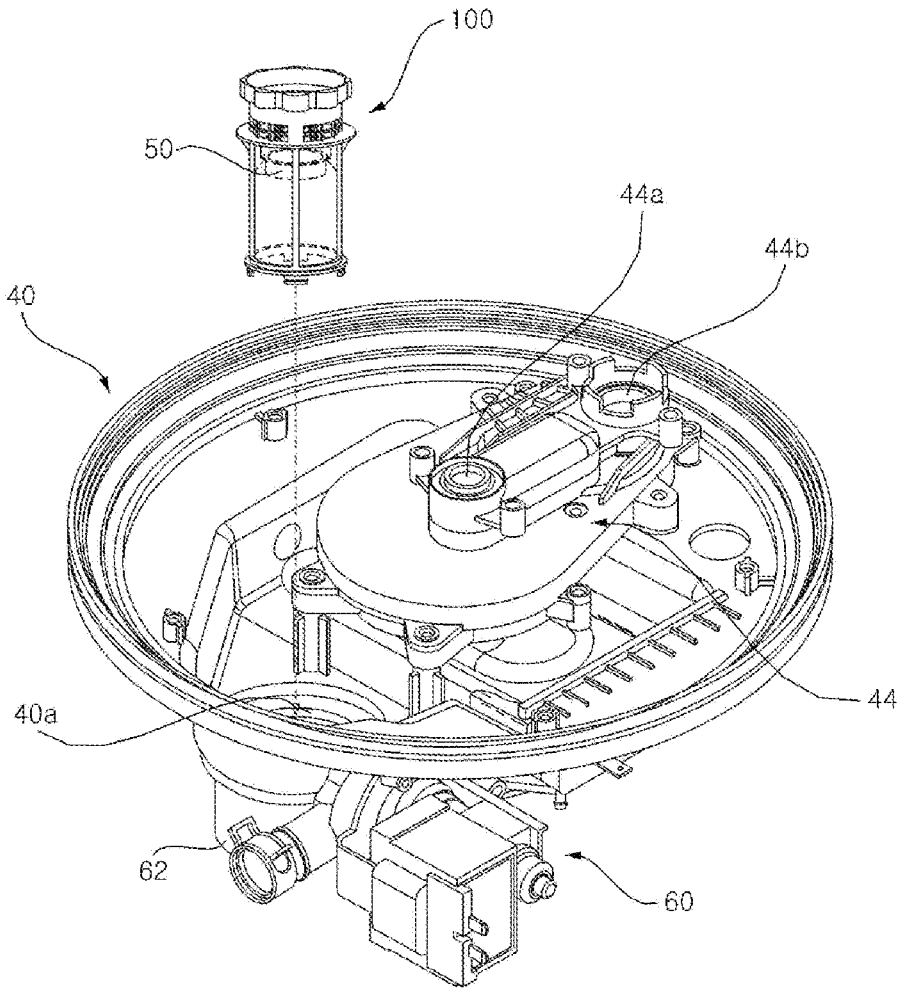
FIG. 2 is a perspective view showing a sump and a filter unit according to an implementation of the present application.
Figure 3:
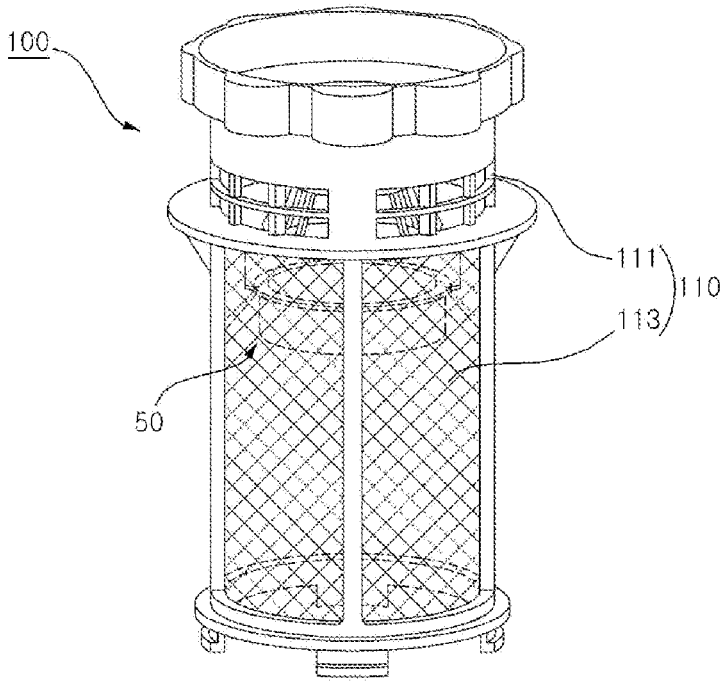
FIG. 3 is a perspective view showing the filter unit and a cap according to an implementation of the present application.

Hereinafter, exemplary implementations of the present application will be described with reference to the drawings illustrating a dishwasher. FIG. 1 illustrates a dishwasher according to an implementation of the present application. FIG. 2 illustrates a sump 40 and a filter unit 100 according to an implementation of the present application. FIG. 3 shows the filter unit 100 and a cap 50 according to an implementation of the present application. Referring to FIGS. 1 to 3, a dishwasher according to an implementation of the present application includes a washing tub 4 defining a dish washing space, a sump 40 for collecting wash water sprayed to the washing tub 4, and a cap 50 disposed at the sump 40 for blocking wash water flowing backward from the sump 40 to the washing tub 4. In addition, the dishwasher further includes a main body 2 having an opening part, through which objects, such as dishes, to be washed are introduced, and a door 6 mounted at the main body 2 for opening and closing the opening part. A blower assembly for blowing wet air out from the dishwasher during drying of dishes is mounted at the inside of the door 6. A detergent supply device for temporarily storing detergent and supplying the detergent into the washing tub 4 is mounted at any one selected from between the main body 2 and the door 6. The main body 2 includes the washing tub 4 having a dish washing space defined therein, a rack assembly 20 and 30 disposed in the washing tub 4 for receiving dishes, the sump 40 disposed at the bottom of the washing tub 4 for collecting wash water, and arms 8, 9, and 10 for spraying the wash water in the sump 40 to the washing tub 4.

The rack assembly 20 and 30 is mounted in the washing tub 4 such that the rack assembly 20 and 30 can be withdrawn from the washing tub 4. The rack assembly 20 and may include a plurality of racks. In this implementation, the rack assembly 20 and 30 includes an upper rack 20 and a lower rack 30. The arms 8, 9, and 10 include a lower arm 8 disposed at the upper side of the sump 40 for spraying wash water to the lower part of the washing tub 4, an upper arm 9 for spraying wash water supplied from the sump 40 to the upper part of the washing tub 4, and a top arm 10 disposed at the upper side of the washing tub 4 for spraying wash water downward.

A water guide 11 for guiding wash water to the upper side of the washing tub 4 is connected to the sump 40. The upper arm 9 and the top arm 10 are connected to the water guide 11 such that wash water can be supplied from the sump 40 to the upper arm 9 and the top arm 10. The sump 40 is open at the top thereof. The open top of the sump 40 is covered by a sump cover 41.

At the sump 40 are mounted a washing pump 42 for pumping out wash water in the sump 40, a housing assembly defining a flow channel for guiding the wash water pumped out by the washing pump 42 to the arms 8, 9, and 10, a filter unit 100 for filtering foreign matter from wash water flowing from the washing tub 4 to the sump 40, and a drainage pump 60 communicating with the lower part of the filter unit 100 for discharging filth filtered by the filter unit 100 and the wash water in the sump 40 out from the dishwasher during a drainage cycle.

The sump 40 is provided with a filter location part 40*a*, in which the filter unit 100 is located.

The arms 8, 9, and 10 spray wash water to the washing tub 4. The wash water sprayed to the washing tub 4 is collected in the sump 40. The sump 40 is disposed at the lower side of the washing tub 4. The filter location part 40*a* is formed at the sump 40. Wash water flows to the sump 40 via the filter location part 40*a*. The washing pump 42 forcibly feeds the wash water collected in the sump 40 to the arms 8, 9, and 10. The washing pump 42 includes a rotary blade and a washing motor. The washing motor rotates the rotary blade to forcibly feed the wash water to the arms 8, 9, and 10. When wash water is raised by the rotary blade, negative pressure almost equal to vacuum may be generated in the washing pump. The wash water collected in the sump 40 can flow to the washing pump 42 due to such a pressure difference. When the washing pump 42 is stopped, the wash water raised to the arms 8, 9, and 10 falls due to gravity. The falling wash water may flow backward from the washing pump 42 to the sump 40. When the water level of the sump 40 is raised by the backwardly-flowing wash water, the wash water in the sump 40 may be reintroduced into the washing tub 4 via the filter location part 40*a* and/or the filter unit 100. In this case, foreign matter filtered by the filter unit 100 may be introduced into the washing tub 4 together with the wash water.

The cap 50 can prevent the wash water and/or the foreign matter from flowing backward to the washing tub 4. The cap 50 may be disposed at the sump 40, the filter location part 40*a*, and/or the filter unit 100. The cap 50 may be disposed at a boundary between the washing tub 4 and the filter location part 40*a*, a boundary between the washing tub 4 and the filter unit 100, an open part of the filter location part 40*a*, and/or an open part of the filter unit 100. The cap 50 may be disposed at the filter location part 40*a* and/or the filter unit 100 such that the cap 50 can move upward and downward. A movable range of the cap 50 may be limited by the filter location part 40*a* and/or the filter unit 100.

The cap 50 may open and close a flow channel connected between the washing tub 4 and the sump 40. When wash water flows from the washing tub 4 to the sump 40, the cap 50 moves downward to open the flow channel. On the other hand, when wash water flows backward from the sump 40 to the washing tub 4, the cap 50 moves upward to close the flow channel. The cap 50 may be moved by water power of the wash water.

The cap 50 may be disposed in the filter location part 40*a*. The cap 50 may be disposed in the filter unit 100. The cap 50 passes wash water flowing from the washing tub 4 to the sump 40 and blocks wash water flowing backward from the sump 40 to the washing tub 4. The cap opens the flow channel only in one direction.

Figure 4:
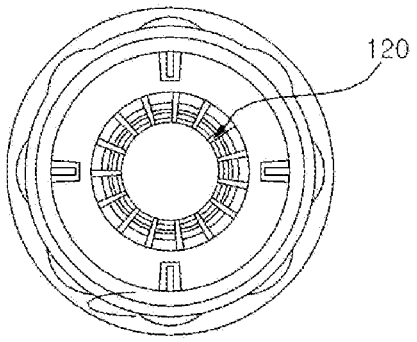
FIG. 4 is a plan view showing the filter unit.

FIG. 4 illustrates the filter unit 100 according to the implementation of the present application.

Referring to FIGS. 3 and 4, the dishwasher according to the implementation of the present application includes the filter unit 100 disposed at the sump 40 for filtering foreign matter from wash water flowing from the washing tub 4 to the sump 40. The cap 50 blocks wash water flowing from the filter unit 100 to the washing tub 4. The filter unit 100 is formed such that the top and bottom of the filter unit 100 are open. The open top of the filter unit 100 serves as an introduction port, through which wash water from the washing tub 4 is introduced. The open bottom of the filter unit 100 is disposed at a filth chamber 62 for serving as a drainage port, through which wash water is drained during operation of the drainage pump 60.

The side of the filter unit 100 may be formed of a mesh material. Wash water introduced into the filter unit 100 may be filtered and then flow to the washing tub 4 via the housing assembly 44. The filter unit 100 is disposed at the filter location part 40*a*. Wash water flowing backward from the arms 8, 9, and 10 may flow to the washing tub 4 via the filter unit 100. The wash water passes through the filter unit 100 formed of the mesh material. Foreign matter is filtered from the wash water by the filter unit 100 and is collected in the filter unit 100. The backwardly-flowing wash water passes through the filter unit 100 formed of the mesh material and is then introduced into the washing tub 4 through the open top of the filter unit 100 together with the foreign matter. The cap 50 is disposed at the filter location part 40*a* and/or the filter unit 100 such that the cap 50 can move upward and downward.

The cap 50 is moved by water power of wash water in a flow direction of the wash water. When the cap 50 moves upward (that is, wash water flows backward), the cap 50 is coupled with the inner circumference of the filter unit 100 to close the flow channel. On the other hand, when the cap 50 moves downward, the cap 50 is separated from the inner circumference of the filter unit 100. When the cap 50 moves downward, a gap is provided between the cap 50 and the inner circumference of the filter unit 100. Wash water flows from the washing tub 4 to the filter unit 100 and then flows through the gap provided between the cap 50 and the filter unit 100. Foreign matter contained in the wash water is collected in the lower end of the cap 50. In the sump 40, the cap 50 isolates the foreign matter from the washing tub 4.

The filter unit 100 includes an outer mesh part 110 of a mesh structure and an inner mesh part 120 disposed in an internal space defined by the outer mesh part 110 for restricting movement of the cap 50 in an anti-gravity direction. The filter unit 100 includes a plurality of mesh parts. The filter unit 100 may include a first outer mesh part 111 and a second outer mesh part 113.

The first outer mesh part 111 has a larger mesh opening size than the second outer mesh part 113 and the inner mesh part 120. The inner mesh part 120 has a larger mesh opening size than the second outer mesh part 113. The first outer mesh part 111 protrudes toward the washing tub 4 for filtering the largest foreign matter. The inner mesh part 120 filters some of the foreign matter having passed through the first outer mesh part 111. The second outer mesh part 113 filters the foreign matter having passed through the inner mesh part 120.

The inner mesh part 120 is disposed inside the outer mesh part 110 for restricting movement of the cap 50. The cap 50 may be disposed such that the cap 50 can move upward and downward. Wash water having passed through the inner mesh part 120 collides with the cap 50 and then falls through a discharge port 150, which will hereinafter be described. The second outer mesh part 113 filters foreign matter from the wash water having passed through the discharge port 150.

Figure 5:
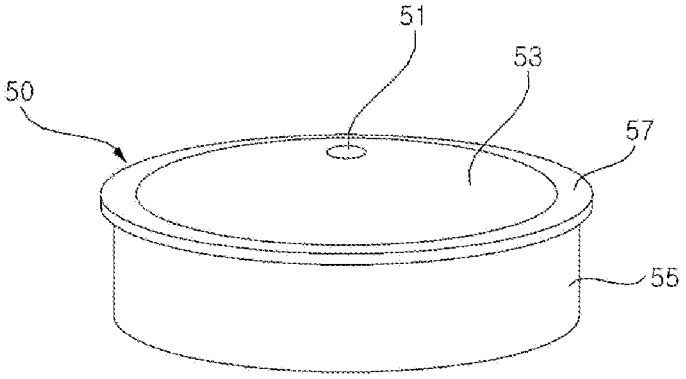
FIG. 5 is a perspective view showing the cap.

FIG. 5 illustrates the cap 50 according to the implementation of the present application.

Referring to FIG. 5, the cap 50 may be provided with an opening hole 51. Water supplied from the outside of the dishwasher is collected in the sump 40. The sump 40 and the washing tub 4 may be maintained at the same atmospheric pressure.

At a raised position of the cap 50, the cap 50 partitions the sump 40 and the washing tub 4 from each other. If the atmospheric pressure in the sump 40 is not equal to that in the washing tub 4, wash water may be driven to any one selected from between the sump 40 and the washing tub 4, or it may be difficult for the wash water to move between the sump 40 and the washing tub 4. The sump 40 defines a space for receiving water supplied from the outside of the dishwasher. During the supply of water to the sump 40, air in the space defined in the sump 40 is discharged through the opening hole 51 formed at the cap 50 as the space is gradually filled with wash water. As a result, the increase of the atmospheric pressure in the sump 40 can be prevented, and therefore smooth supply of water into the sump 40 may be achieved.

When the wash water flows backward, the opening hole moves toward a core 170 and then comes into tight contact with the core 170. As a result, the opening hole 51 may be covered. The cap 50 includes a roof 53 disposed facing in a flow direction of wash water and a receiving unit 55 extending from the roof in a gravity direction for guiding backwardly-flowing wash water to the roof 53. The roof 53 may widely extend in a lateral direction.

The roof 53 may be flat or protrude in one direction. Alternatively, the roof 53 may be conical. The receiving unit 55 extends downward from the roof 53. The roof 53 may be cylindrical. While wash water flows backward from the sump 40 to the washing tub 4, the wash water passes through the receiving unit 55 to apply water pressure to the roof 53. The cap 50 further includes a rim 57 disposed at the edge of the roof 53 while protruding in a lateral direction for restricting movement of the cap 50 when the cap 50 moves upward or downward. The rim 57 protrudes in the lateral direction. The rim 57 may include eaves. When the cap 50 moves upward, the top of the rim 57 may come into contact with a hood 160. The rim 57 and the hood 160 may match in shape with each other such that the rim 57 and the hood 160 can come into tight contact with each other.

When the cap 50 moves downward, the bottom of the rim 57 may come into contact with a hook 140. The hook 140 restricts downward movement of the rim 57. The rim 57 is separated from the inside of the filter unit 100 to form a discharge port 150. The hook 140 supports the rim 57 across the discharge port 150. The roof 53 protrudes upward in a convex shape to guide wash water flowing from the washing tub 4 to the sump 40 outward in a radial direction.

The upper side of the roof 53 protrudes in a convex shape. The lower side of the roof 53 may be depressed in a concave shape. The upper side of the roof 53 disperses wash water falling from the washing tub 4 to the sump 40 outward, and pressure generated by a stream of water flowing backward from the sump 40 to the washing tub 4 is applied to the lower side of the roof 53. When the wash water flows backward, therefore, the roof 53 moves upward.

Figure 6:
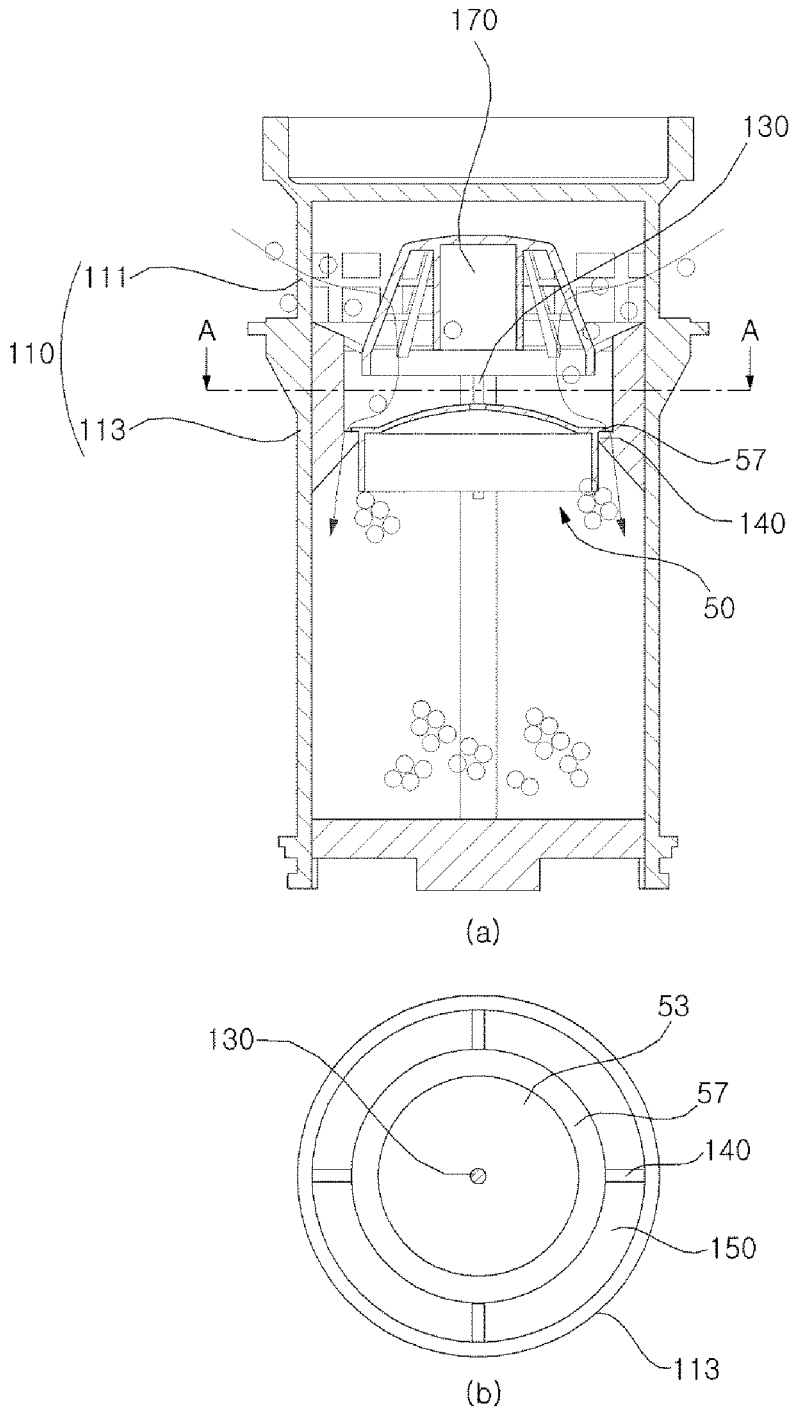
FIG. 6 is a view showing an example state in which a flow channel is opened by the cap.
Figure 7:
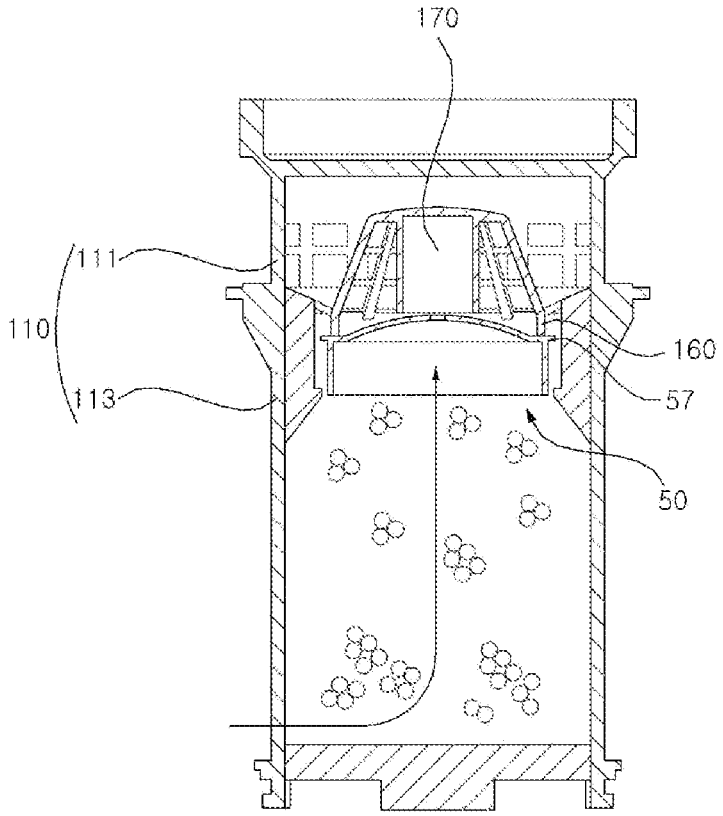
FIG. 7 is a view showing an example state in which the flow channel is closed by the cap of FIG. 6.

FIG. 6 illustrates the filter unit 100 in a lowered state of the cap 50 (*a*) and the cap 50 when viewed from above at that time (*b*). FIG. 7 shows the filter unit 100 in a raised state of the cap 50.

Referring to FIGS. 6 and 7, the filter unit 100 may include a guide pin 130 extending through the opening hole 51 in a movement direction of the cap 50. The cap 50 is guided by the guide pin 130 such that the cap 50 can move upward or downward to close or open the flow channel of the wash water. The guide pin 130 may extend upward and downward. The cap 50 moves upward and downward. The cap 50 may move in a gravity direction and in an anti-gravity direction.

The filter unit 100 defines a moving path along which the cap 50 is movable. The guide pin 130 extends through the opening hole 51. The guide pin 130 is connected to a core 170, which will hereinafter be described. The core 170 is disposed in the center of the inner mesh part 120. The cap 50 may be moved upward and downward by pressure generated by the stream of water. The guide pin 130 guides the cap 50 such that the cap 50 can stably move between the hook 140 and the hood 160. The guide pin 130 guides the cap 50 such that the rim 57 is caught by the hook 140 or the rim comes into contact with the hood 160.

The dishwasher according to the implementation of the present application further includes a hook 140 disposed in the sump 40 for restricting downward movement of the cap 50. In addition, the dishwasher according to the implementation of the present application further includes a hood 160 disposed in the sump 40 for restricting upward movement of the cap 50. The cap 50 may be moved by pressure generated by the stream of water. The cap 50 performs different functions based on the position thereof.

At a lowered position of the cap 50, wash water flows through a gap defined between the rim 57 and the filter unit 100. A discharge port 150 is provided between the rim 57 and the filter unit 100. At a raised position of the cap 50, the rim 57 contacts the hood 160. As a result, wash water is prevented from passing through a gap defined between the rim 57 and the hood 160.

The rim 57 and the hood 160 close the flow channel of the wash water. According to implementations, the roof 53 may contact the hood 160 to close the flow channel of the wash water.

In addition, according to implementations, the hook 140 may directly support the receiving unit 55. In this case, the rim 57 may be omitted or used to guide the cap 50.

The hook 140 and/or the hood 160 may be disposed in the filter unit 100. The hood 160 may be disposed in the inner mesh part 120. The hood 160 may extend upward and downward. The hood 160 may come into tight contact with the roof 53 or the rim 57 to close the flow channel of the wash water. In an implementation of the present application, a plurality of hooks 140 may be provided, and the hooks 140 may be spaced apart from each other to form discharge ports 150. The hooks 140 may be disposed in the filter unit 100. The hooks 140 restrict downward movement of the cap 50. The cap 50 may move upward without being affected by the hooks 140.

The outer diameter of the rim 57 is less than the inner diameter of the filter unit 100. The rim 57 may be circular. A gap is provided between the inner circumference of the filter unit 100 and the rim 57. The discharge ports 150 are provided between the respective hooks 140. Wash water flowing from the washing tub 4 to the sump 40 passes through the inner mesh part 120 and then falls to the roof 53. After collision with the roof 53, the wash water flows downward through the discharge ports 150.

The hood 160 comes into contact with the cap 50 to block the wash water such that the wash water cannot flow backward from the sump 40 to the washing tub 4. The backwardly-flowing wash water is introduced into the receiving unit 55. The wash water applies pressure to the roof 53. The wash water applies force to the roof 53 in an anti-gravity direction. The cap 50 moves upward. At least one selected from between the rim 57 and the roof 53 comes into tight contact with the hood 160. The opening hole 51 may be covered by the guide pin 130 and the core 170. The diameter of the guide pin 130 may be gradually increased toward the upper side thereof such that the guide pin 130 can directly cover the opening hole 51 when the cap 50 comes into tight contact with the hood 160.

A dishwasher according to another implementation of the present application includes a washing tub 4 defining a dish washing space, a sump 40 for collecting wash water sprayed to the washing tub 4, a cap 50 movable by wash water flowing in the sump 40, and a filter unit 100 disposed in the sump 40 for filtering foreign matter and for allowing or preventing communication between the washing tub 4 and the sump 40 based on the position of the cap 50. The cap 50 is moved by water power of wash water. When wash water flows from the washing tub 4 to the sump 40, the wash water applies force to the cap 50 in a gravity direction.

When the wash water flows backward from the sump 40 to the washing tub 4, the wash water applies force to the cap 50 in an upward direction. Accordingly, the cap may be moved by the flow of the wash water without the necessity of an additional drive unit. The filter unit 100 restricts movement of the cap 50. When the cap 50 moves downward, the filter unit 100 opens a flow channel. On the other hand, when the cap 50 moves upward, the filter unit 100 closes the flow channel.

As is apparent from the above description, the present application can have one or more of the following effects.

First, it may be possible to prevent wash water from flowing backward from the filter unit to the washing tub in a state in which the washing pump is off, thereby preventing contamination of the washing tub.

Second, it may be possible to perform a backward flow blocking function while maintaining the structure of a conventional sump.

Third, it may be possible to perform a backward flow blocking function only using water power without an additional power source.

Fourth, it may be possible to prevent contaminants remaining in backwardly-flowing wash water from being discharged out of the filter, thereby preventing contamination of the washing tub.

It will be apparent that, although the preferred implementations have been shown and described above, the present application is not limited to the above-described specific implementations, and various modifications and variations can be made by those skilled in the art without departing from the gist of the appended claims. Thus, it is intended that the modifications and variations should not be understood independently of the technical spirit or prospect of the present application.

What is claimed is:

1. A dishwasher comprising:

a washing tub defining a space that is configured to receive dishes to be washed by wash water;

a sump configured to receive and collect wash water flowing from the washing tub;

a filter unit disposed at the sump and configured to filter the wash water flowing from the washing tub to the sump;

a flow channel configured to guide wash water flow between the filter unit and the washing tub; and a cap disposed in the filter unit and configured to open and close the flow channel, wherein the cap defines an opening hole and the filter unit comprises a guide pin extending through the opening hole, the cap being configured to be moved upward and downward along the guide pin by a stream of water, and wherein the cap closes the flow channel at an upwardly moved position and opens the flow channel at a downwardly moved position.

2. The dishwasher according to claim 1, wherein the filter unit further comprises:

an outer mesh part having a mesh shape and defining an internal space; and an inner mesh part disposed in the internal space and configured to restrict an upward movement of the cap.

3. The dishwasher according to claim 1, further comprising a hook disposed in the sump and configured to restrict a downward movement of the cap.

4. The dishwasher according to claim 3, wherein the hook comprises a plurality of hooks, the plurality of hooks being spaced apart from each other to form discharge ports.

5. The dishwasher according to claim 1, further comprising a hood disposed in the sump and configured to restrict an upward movement of the cap.

6. The dishwasher according to claim 5, wherein the hood is configured to contact the cap to prevent wash water from flowing from the filter unit to the washing tub.

7. The dishwasher according to claim 1, wherein the cap comprises:

a roof that faces a flow direction of wash water and on which the opening hole is defined; and a tubular receiving unit extending downward from the roof.

8. The dishwasher according to claim 7, wherein the cap further comprises a rim protruding from the roof in a radial direction, the rim protruding more radially outward than the tubular receiving unit, and the filter unit further comprises a hook for supporting the rim at a lowered position of the cap.

9. The dishwasher according to claim 1, further comprising:

a spray arm configured to spray wash water into the washing tub; and a washing pump configured to pump wash water from the sump to the spray arm.

10. A dishwasher comprising:

a washing tub defining a space that is configured to receive dishes to be washed by wash water;

a sump configured to receive and collect wash water introduced from the washing tub;

a washing pump configured to pump the received wash water from the sump to the spray arm;

a filter unit disposed in the sump and configured to filter the wash water introduced from the washing tub;

a flow channel guiding wash water flow between the filter and the washing tub;

a spray arm connected to the sump via the flow channel; and a cap disposed in the filter unit and configured to move upward and downward, the cap being configured to move downward by a stream of water introduced from the washing tub to the sump to open the flow channel during operation of the washing pump and being configured to move upward by wash water flowing from the spray arm to the sump to close the flow channel based on the operation of the washing pump being stopped, wherein the cap defines an opening hole and the filter unit comprises a guide pin extending through the opening hole, the cap being configured to be moved upward and downward along the guide pin by the stream of water.

11. The dishwasher according to claim 10, wherein the filter unit comprises an outer mesh part having an open top that enables communication between the washing tub and a mesh net that is formed at a side of the mesh part such that wash water introduced through the open top is filtered through the mesh net while flowing outward in a radial direction, and the cap is disposed inside the outer mesh part.

12. The dishwasher according to claim 11, wherein the outer mesh part comprises a hook disposed at a lower side of the cap, the hook being configured to restrict a downward movement of the cap.

13. The dishwasher according to claim 12, wherein the hook comprises a plurality of hooks disposed at intervals in a circumferential direction.

14. The dishwasher according to claim 11, wherein the outer mesh part comprises a hood disposed at an upper side of the cap, the hood being configured to restrict an upward movement of the cap.

15. The dishwasher according to claim 14, wherein the flow channel connects an upper region and a lower region of the hood.

16. The dishwasher according to claim 15, wherein the flow channel is closed by sealing between the cap and the hood.

* * * * *